US005986248A

United States Patent [19]

Matsuno et al.

[11] Patent Number: 5,986,248

[45] Date of Patent: Nov. 16, 1999

[54] FOOD CONTAINER FOR MICROWAVE HEATING OR COOKING

[75] Inventors: Ichiro Matsuno; Hirotaka Sasaki, both of Saitama-ken, Japan

[73] Assignee: Snow Brand Milk Products Co., Ltd., Hokkaido, Japan

[21] Appl. No.: 09/082,841

[22] Filed: May 21, 1998

[30] Foreign Application Priority Data

Jul. 14, 1997 [JP] Japan ..... 9-202584

[51] Int. Cl.[6] ..... H05B 6/80

[52] U.S. Cl. ..... 219/728; 99/DIG. 14

[58] Field of Search ..... 219/728–730; 99/DIG. 14

[56] References Cited

U.S. PATENT DOCUMENTS

| | | | |
|---|---|---|---|
| 4,626,641 | 12/1986 | Brown et al. | 219/728 |
| 4,888,459 | 12/1989 | Keefer et al. | 219/728 |
| 4,992,638 | 2/1991 | Hewitt et al. | 219/728 |
| 5,310,980 | 5/1994 | Beckett et al. | 219/709 |
| 5,396,052 | 3/1995 | Petcavich et al. | 219/725 |
| 5,593,610 | 1/1997 | Minerich et al. | 219/728 |

*Primary Examiner*—Teresa Walberg
*Assistant Examiner*—Jeffrey Pwu
*Attorney, Agent, or Firm*—Knobbe, Martens, Olson & Bear, LLP

[57] ABSTRACT

A food container for microwave heating or cooking has: a bottom portion having an area which is covered with a microwave non-transmittable material and which is located between the center and the periphery of the bottom portion; a side wall having an area covered with a microwave non-transmittable material; and a leg structure provided under the bottom portion. The temperature rises in the center portion and near the circumferential side portion is facilitated, thereby effectively and easily achieving uniform heating of a food such as a frozen food.

6 Claims, 7 Drawing Sheets

FOOD CONTAINER FOR MICROWAVE HEATING OR COOKING

BACKGROUND

1. Field of the Invention

This invention relates to a food container containing processed or precooked foods, which are subjected to microwave heating, or chilled or frozen foods, which are subjected to microwave cooking or heating, and particularly to that allows for uniform temperature increases and uniform heat distribution in filled precooked foods (the aforesaid foods are hereinafter referred to as "precooked foods") when heated with a microwave oven.

2. Background of the Art

Precooked foods, which are easily used simply by heating with a microwave oven when served, are commercially available. Such precooked foods include gratin, lasagna, rice with curry, or the like, which is packed into a container for microwave heating. Heretofore, the containers for microwave heating normally have been made of a microwave transmittable material. However, the containers are associated with problems in that, upon heating with a microwave oven, the temperature of a portion of the precooked food near an inner side wall of the container is high while that of a center portion of the precooked food is low, and in that the temperature near the upper surface of the precooked food rises quickly while the temperature near the bottom of the container rises slowly.

In view of the above problems of unevenness in temperature and heating rates, various types of containers, which alleviate uneven heating when heating the containers containing precooked foods with a microwave oven, have been developed.

For example, Japanese Patent Publication No. 59-6789 discloses a food package for heating or cooking precooked foods using a hot air convection type of home-use microwave oven, which food package comprises a bottom, a circumferential side wall having an upper edge outwardly curved, and a tray having circumferential rims extending horizontally, wherein a circumferential surface of the side wall of the container, or at least an inner surface thereof, or an upper portion of the rims and a wall portion adjacent to their corners are made of or coated with a microwave reflective material or microwave non-transmittable material, and wherein the bottom is made of a microwave transmittable material, or is detachable.

Further, Japanese Patent Laid-open No. 52-112150 discloses a food container for microwave heating, comprising: a body having a bottom wall, a side circumferential wall, and projections projecting from the bottom wall and forming a plurality of segments; and a lid having a top wall made of a microwave transmittable material, a circumferential side wall, and projections projecting from the side circumferential wall and the top wall, wherein a plurality of individual segments are formed, separately from each other, by combining the body, the lid, and the respective circumferential wall and projections, and wherein the circumferential side wall and the projections of the lid extend to the interior of the segments of the body so as to fit into the circumferential side wall and the projections of the body. This patent application also teaches that selective heating suitable for a food stored in each individual segment can be conducted by selectively locating microwave-transmittable portions and microwave non-transmittable portions formed on the outer surface of the container, using a metal foil or ink, which does not transmit microwaves, on the outer surface of the body and the lid, thereby preventing transmission of microwaves therethrough.

As described above, various types of food containers for microwave heating have been developed. However, the container disclosed in Japanese patent publication No. 59-6789 can prevent an extreme temperature rise on the inner side of the circumferential walls or the corners; however, since, in the container, the side circumferential walls or the corners formed by the rims and the container are simply coated with a microwave non-transmittable material, a temperature rise in the center of the container, especially in the center of a frozen food adjacent to the bottom, cannot be controlled effectively. Thus, the container has a problem in that it is difficult to uniformly heat a precooked food at an even temperature rise.

On the other hand, the container for microwave heating disclosed in Japanese Patent Laid-open No. 52-112150 is designed for heating different foods stored in the respective segments by differentiating heating manners depending on the food; however, since heating of the respective segments is conducted by passing microwaves through a microwave transmission hole having a limited area located in the center, the temperature rises quickly in the center, but the temperature rises slowly at the circumferential wall and the corners. Thus, nonuniformity of heating cannot be avoided.

As described above, heretofore, any containers containing a frozen food for microwave heating do not allow uniform heating in the frozen food placed evenly in the containers, thereby limiting embodiments or applications of the containers.

SUMMARY OF THE INVENTION

The present invention has exploited a food container for microwave heating. An objective of the present invention is to provide a food container for microwave heating, which solves the above problems, i.e., by achieving uniform heating at a uniform temperature rise, especially preventing temperature differences between the center and the circumferential wall.

Namely, one important aspect of the present invention is a food container for microwave heating or cooking, comprising: a bottom portion made of a microwave transmittable material and having a center and a periphery, said bottom portion having an area covered with a microwave reflective material, a microwave non-transmittable material, or a microwave semi-transmittable material, said area being located between the center and the periphery; a side wall made of a microwave transmittable material and having an area extending around the side wall, said area covered with a microwave reflective material, a microwave non-transmittable material, or a microwave semi-transmittable material; and a leg structure provided under the bottom portion.

According to the present invention, by using a leg structure at the bottom, the food can be heated not only from the upper portion of the food, but also simultaneously from the bottom using microwaves reflected by the turntable and the bottom of the microwave oven and passing through the bottom plate of the container. Further, by placing the microwave non-transmittable material on the back side of the bottom plate between the center and the peripheral edge of the bottom plate to increase irradiation with microwaves in the center portion and near the circumferential side portion, the temperature rise in these portions is facilitated, thereby effectively and easily achieving uniform heating.

BRIEF DESCRIPTION OF THE FIGS.

Figure 4:
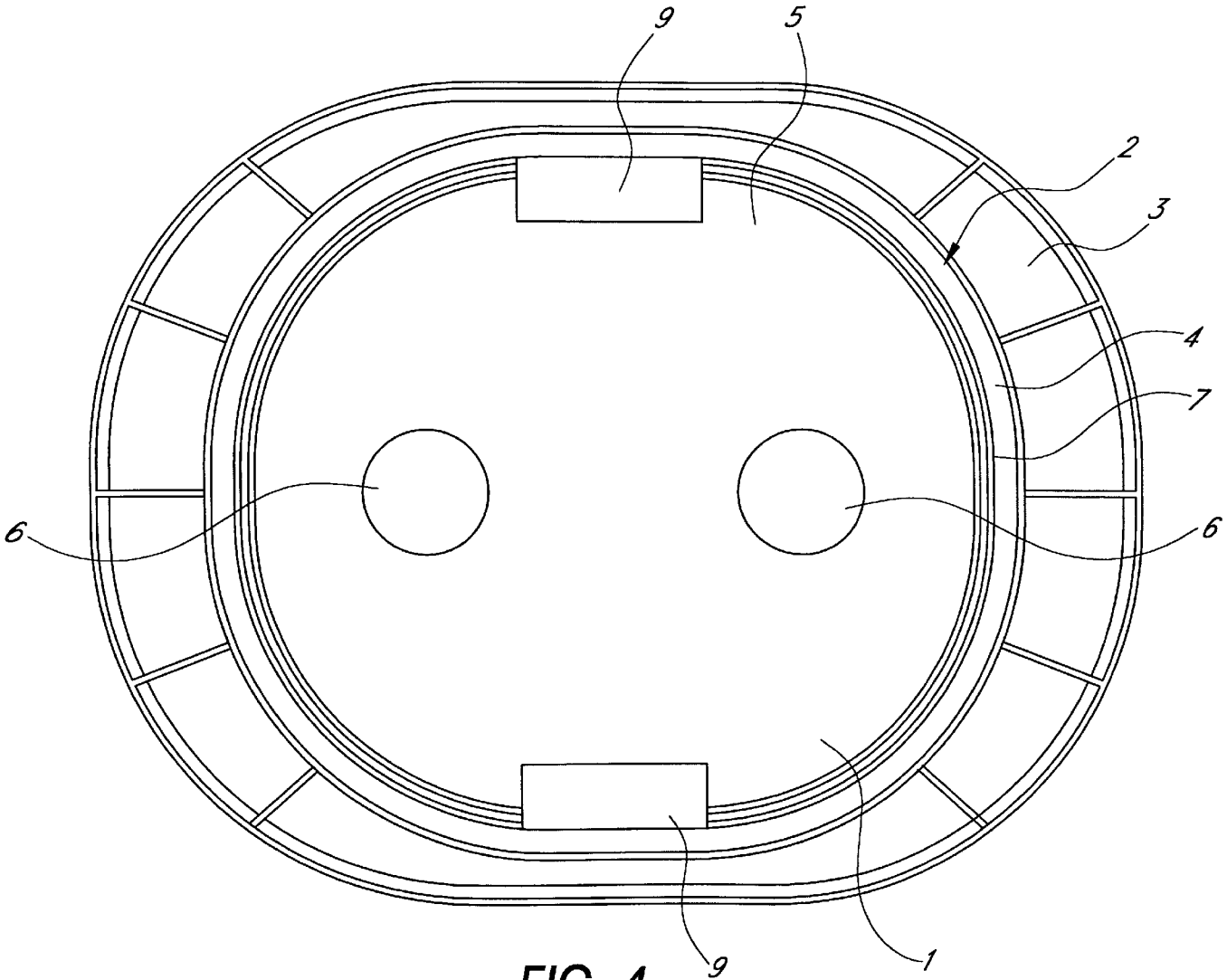

FIG. 4 is a schematic bottom view showing the outer surface 5 of the container A, wherein two circular pieces of aluminum foil 6 are attached onto the oval bottom plate 1.

Figure 5:
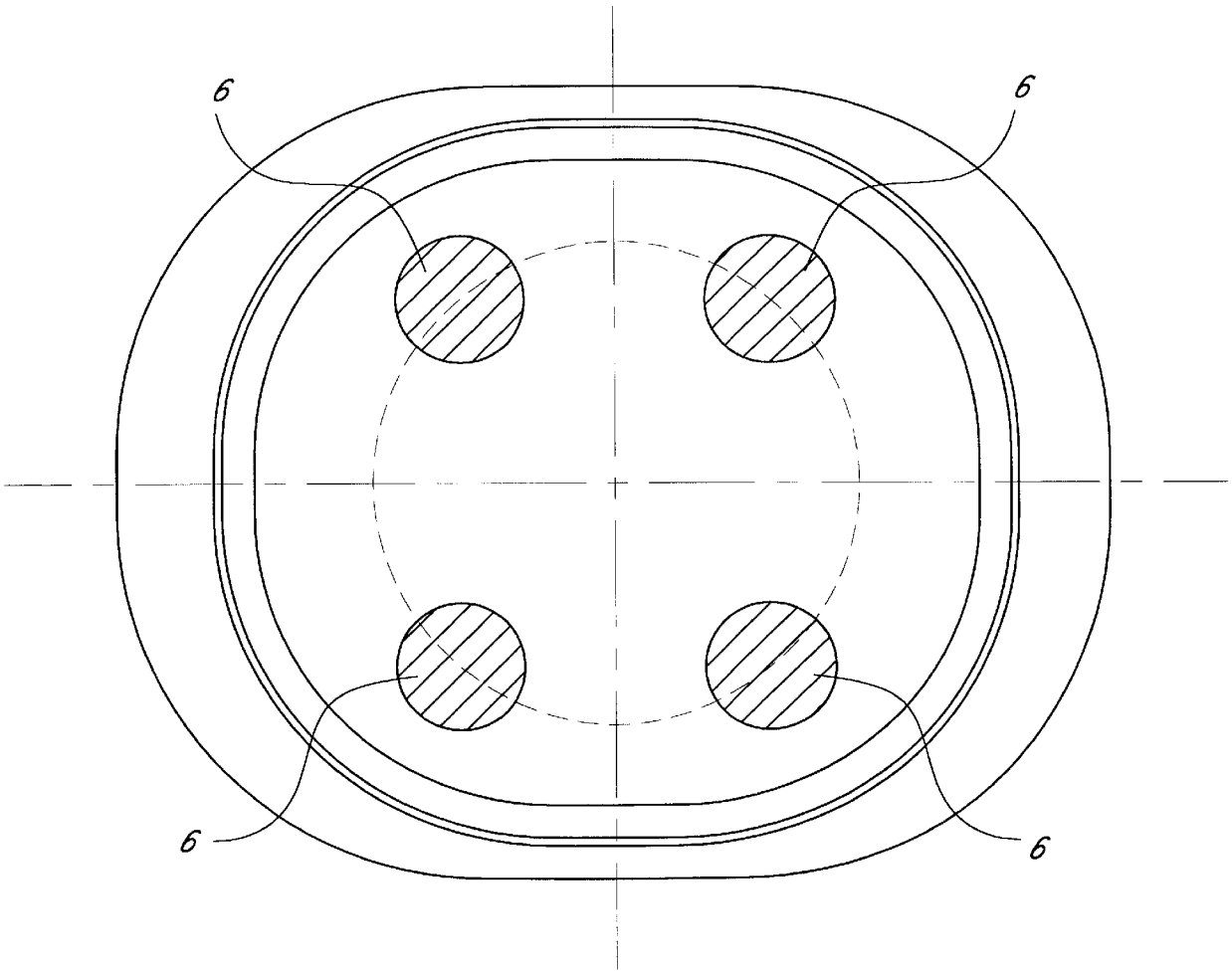

FIG. 5 is a schematic view showing another embodiment wherein four circular pieces of aluminum foil are disposed in diagonal lines on the outer surface 5 of the bottom plate 1.

Figure 6:
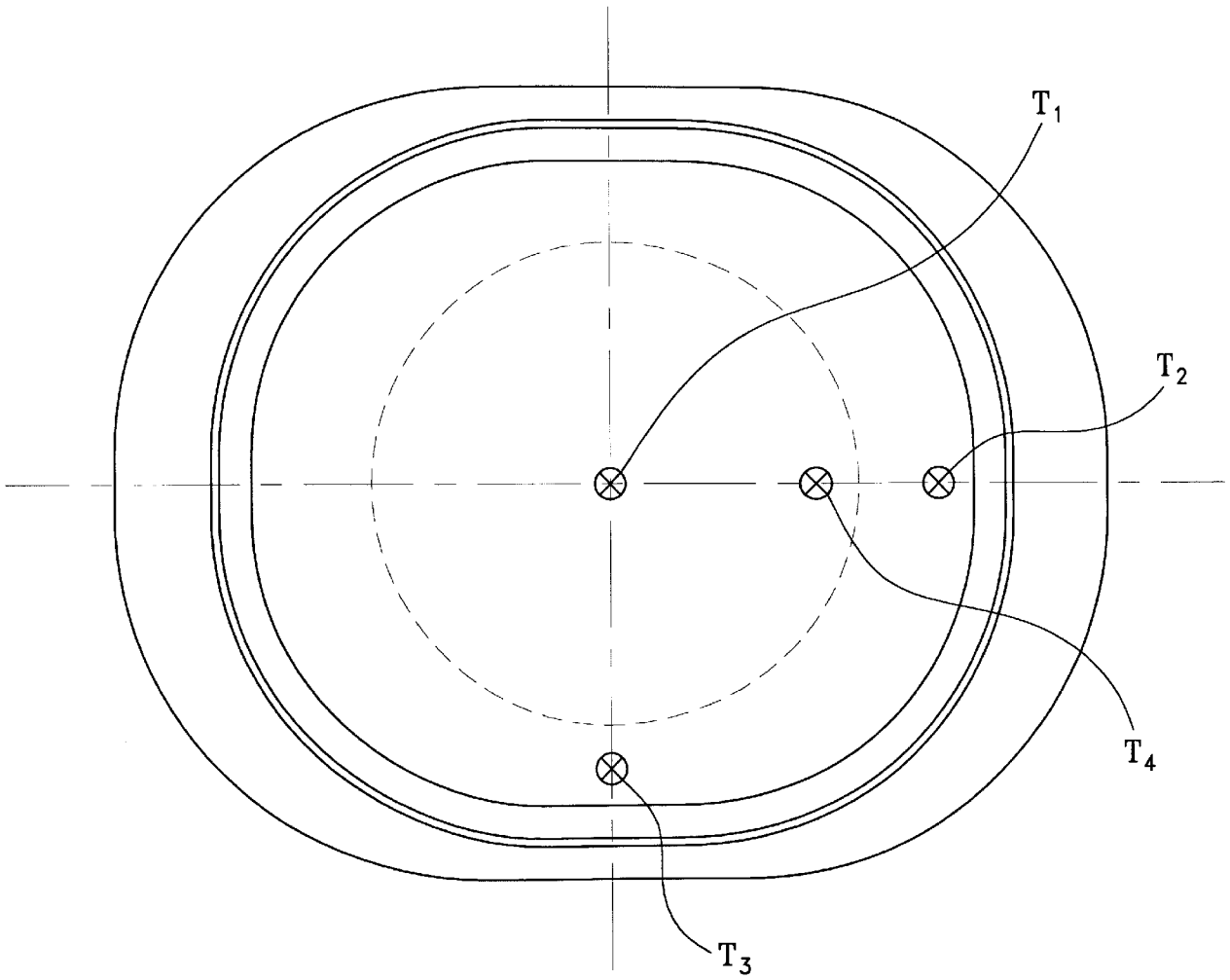

FIG. 6 is a schematic view showing the positions where the temperatures were measured in the experiment described later.

Figure 7:
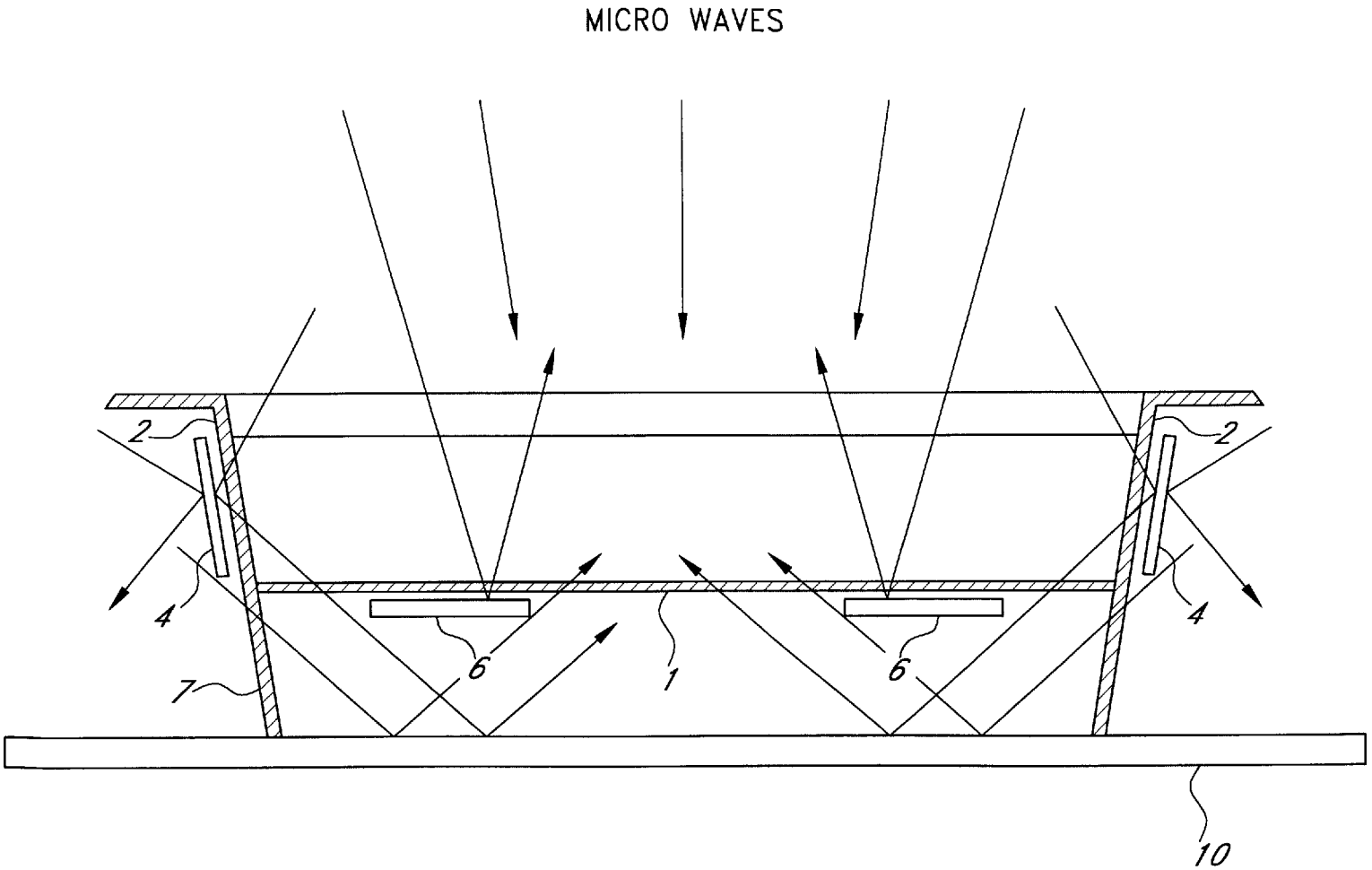

FIG. 7 is a schematic view illustrating the manners of microwave transmission and reflection in the container, which has a microwave transmittable material placed on the outer surface of the side wall and the back of the bottom plate, according to the present invention.

DETAILED DESCRIPTION OF THE PREFERRED EMBODIMENTS

In the container for microwave heating in the present invention, by using a leg structure at the bottom, microwaves can transmit not only downward through the top portion but also simultaneously upward through the bottom portion, in which the microwaves passing through the bottom portion include microwaves reflected by the turntable and the bottom floor of the microwave oven. Further, due to the presence of the microwave non-transmittable material (microwave reflective material) formed on the bottom of the container, part of the microwaves reflected by the turntable and the bottom floor of the microwave oven are re-reflected by the material so as to focus the microwaves on the center where the temperature is slow to rise, thereby promoting a temperature rise in the center and allowing uniform heating as a whole. For example, FIG. 7 illustrates the manners of microwave transmission and reflection in the container, which has a microwave transmittable material placed on the outer surface of the side wall and the back of the bottom plate. In this figure, a microwave non-transmittable material 4 is placed on a side wall 2 of the container supported by a leg structure 7, and similarly, a microwave non-transmittable material 6 is placed on a bottom plate 1 (in this figure, a gap between the container and the materials is shown solely for easy understanding, but in fact, they are intimately in contact). When microwaves are emitted from a waveguide tube (not shown) of the microwave oven in a direction indicated with arrows, microwaves heat the contents in the container as a whole, upon passing through a microwave transmittable material of the lid portion. Since a microwave non-transmittable material reflects microwaves, the microwave non-transmittable material 6 of the bottom plate and the microwave non-transmittable material 4 of the side wall reflect microwaves so as to irradiate the precooked food in the container. In particular, the contents located in the center receive microwaves from various directions, and are thus heated evenly without localization of heating. In the present invention, since the microwave non-transmittable material is placed not only on the side wall but also on the bottom plate, the above effects can be facilitated as compared with an embodiment wherein the microwave non-transmittable material is placed only on the side wall.

The container itself is made of a microwave transmittable material, and thus, the leg structure can either be continuously shaped to extend from the back of the bottom plate or be discontinuously shaped by using a plurality of cut-outs, in view of uniform heating.

The container having the leg structure is covered with a microwave non-transmittable material at appropriate locations. When the leg structure is shaped discontinuously below the bottom plate, the microwave non-transmittable material can be placed to extend from a portion having cut-outs to the bottom plate.

In the present invention, the partial covering of the bottom plate with the microwave non-transmittable material is such that 5% to 20%, for example, of the area of the bottom plate are covered at a position nearly halfway between the center of the bottom plate and the edge of the bottom.

The shape of the partial covering of the bottom plate with the microwave non-transmittable material may be circular, oval, four-sided, star-shaped, triangular, or horseshoe-shaped, and may be continuous or discontinuous.

The present invention will be explained in detail below.

The present invention relates to a container for microwave heating, wherein the container is filled with a precooked food such as a pasta gratin and a rice gratin, and upon heating with a microwave oven, the food is served.

The container for microwave heating of the present invention may be made of microwave transmittable material such as synthetic resin and composite material using glass, ceramic, or paper, as the primary material, and which is coated with synthetic resin. From an economical point of view, a container made of synthetic resin is particularly preferable.

As synthetic resin, at least one thermoplastic resin, such as polyethylene, polypropylene, polystyrene, polyethyleneterephtalate, poly(vinyl chloride), and poly (acrylonitrile-butadiene-styrene), may be used, and the resin is shaped by vacuum forming, air-pressure forming, compression molding, or injection molding.

The container is comprised of a bottom plate and a side wall extending upward from the circumference of the bottom plate, as well as a leg structure having a height of 3–10 mm provided on the outer surface of the bottom plate. A rim extending outwardly and horizontally is provided on the upper edge of the side wall, as necessary, so that a lid may be attached to the rim to seal the container after being filled with a precooked food, or after being cooled or frozen. When no rim is provided, the container is sealed with a lapping film.

In the present invention, a microwave non-transmittable material is placed on the side wall and the bottom plate of a container shaped as described above in an appropriate size. Placement of the microwave non-transmittable material onto the container can be conducted by adhering an aluminum foil or an aluminum vapor-deposited film to the surface of the container, or by printing directly on the surface with an aluminum vapor-deposited product or aluminum paste-like product.

Further, if the container is made of synthetic resin, the microwave non-transmittable material can be subjected to in-mold molding when forming the container. In the above, when adhering thereto an aluminum foil or an aluminum vapor-deposited film, the foil or the film is preferably laminated with composite paper made of paper and synthetic resin in such a way as to place the composite paper on the outer surface, in order to avoid the occurrence of sparks at the corners or edges of the aluminum material.

Covering the side wall of the container with a microwave non-transmittable material is conducted either on the inner surface or the outer surface thereof. Similarly, regarding the bottom plate of the container, covering is conducted either on the outer surface or the inner surface. From a hygienic point of view, preferably, covering is conducted on a surface which is not in direct contact with a food, such as on the outer surface of the bottom plate and the outer surface of the side wall. Covering treatment includes pasting a belt around the side wall. For example, a belt made of a microwave non-transmittable material can be pasted all around the side wall, or a belt made of the same material and having a width such that the height of a food packed in the container is equivalent to the width, so that transmission of microwaves toward to the food through the side wall can fully be blocked. In this way, overheating of the sides of the food can be effectively prevented.

Covering the bottom plate is conducted preferably in 5% to 20% portions of the entire area. If the covered portion is more than 20%, heating at the bottom becomes low, creating uneven heating with respect to the entire food mass. If the covered portion is less than 5%, heating in the center becomes low, creating uneven heating with respect to the entire food mass. However, the above preferable range depends on the size of the food, the shape of the food, the compositions constituting the food, the power of the microwave oven, and the like. The location of the covering at the bottom is preferably halfway between the center and the peripheral edges of the bottom plate. The shape of the covering includes, but is not limited to, a circular, oval, four-sided, star-shaped, triangular, or horseshoe-shaped pattern, and these patterns may be continuous or discontinuous.

After forming a container as above, a desired area of the container is covered with a microwave non-transmittable material. In the container, a food is introduced, and then frozen. At serving, by heating or cooking the frozen food in the container, the frozen food is heated evenly without the occurrence of temperature variation or localized heating.

This is because the container has a leg structure, and a zone halfway between the center and the peripheral edges of the bottom plate is covered with a microwave non-transmittable material, thereby increasing the amount of microwaves transmitted through the center and the peripheral edges of the bottom plate. As a result, the temperature rise in the center and near the peripheral edges is facilitated, and uneven heating can be eliminated as a whole, thereby obtaining a cooked food evenly heated.

That is, by using a leg structure having a height of 3 to 10 mm, for example, the food is heated not only from the upper portion of the food, but also simultaneously from the bottom using microwaves reflected by the turntable and the floor of the microwave oven and passing through the bottom plate of the container. In particular, the microwave non-transmittable material placed on the back side of the bottom plate reflects microwaves which have been reflected by the turntable and the oven floor to make the microwaves focus on a central portion of the foods where the temperature slowly rises, thereby well heating the central portion to uniformly heat the foods. In a conventional container, in order to heat the central portion of a food to a given temperature, even if other portions of the food are overheated, heating must be continued. In the present invention, the temperature rise is facilitated at the central portion of the food so as to conduct uniform heating throughout the food, thereby allowing shortening a time period of cooking or heating. As described above, in the container for microwave heating of the present invention, uniform heating is achieved due to partial transmission of microwaves by using leg structures and covering the bottom plate with a microwave non-transmittable material. Thus, if the turntable of the microwave oven is made of a metal, the above effects are more significant.

EXAMPLE

The present invention will be explained in detail with reference to the figures.

Example 1

Synthetic Resin Container

Figure 1:
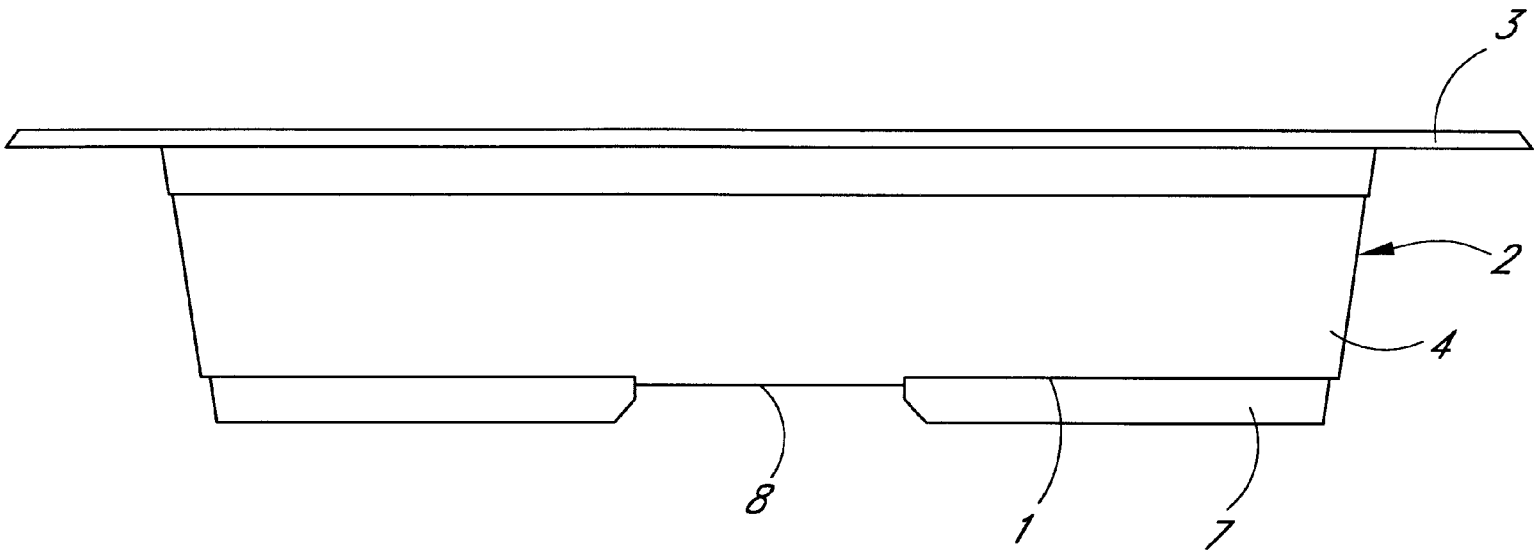
FIG. 1 is a schematic front view showing a food container A for microwave heating or cooking.
Figure 2:
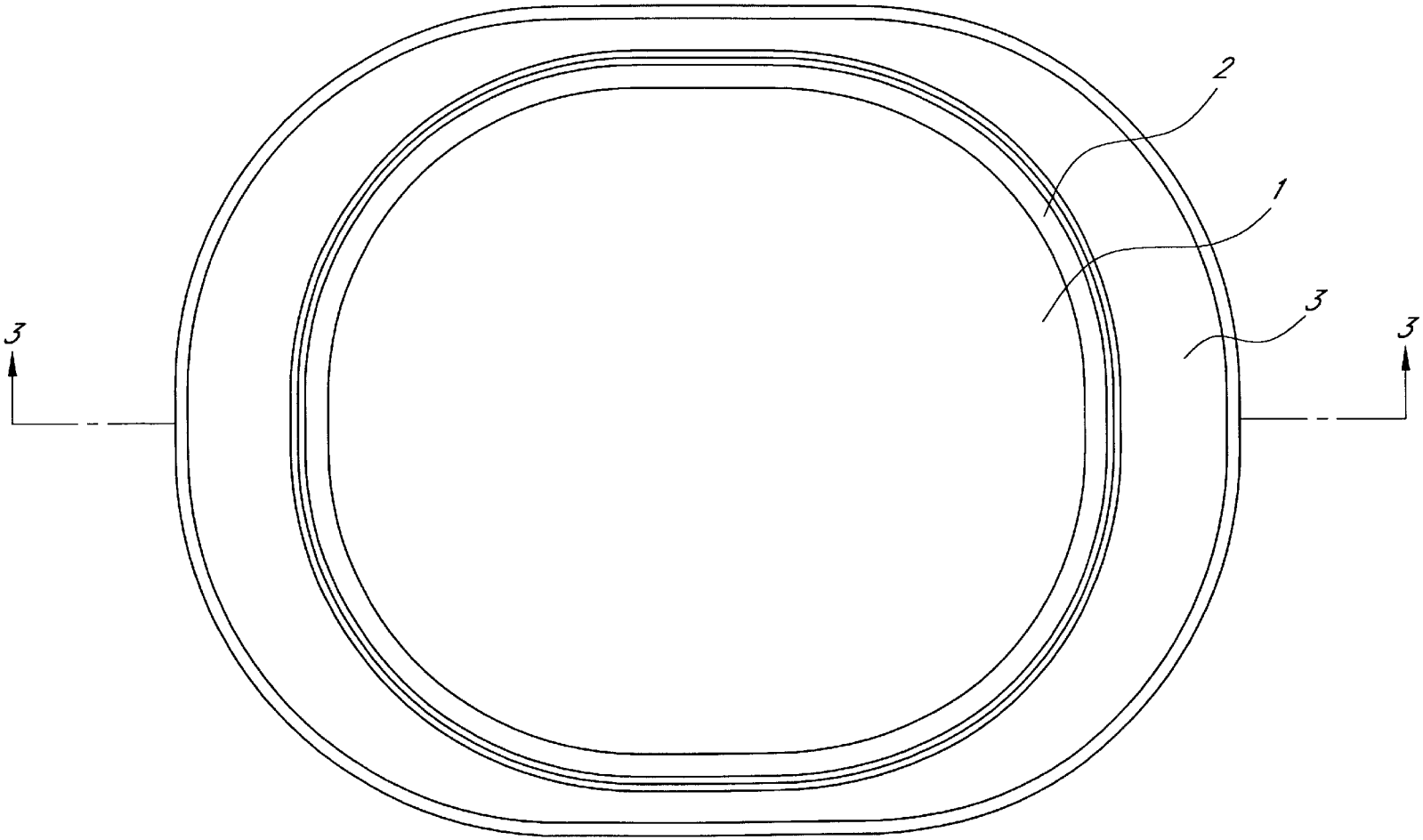
FIG. 2 is a schematic plane view of the container A illustrated in FIG. 1.
Figure 3:
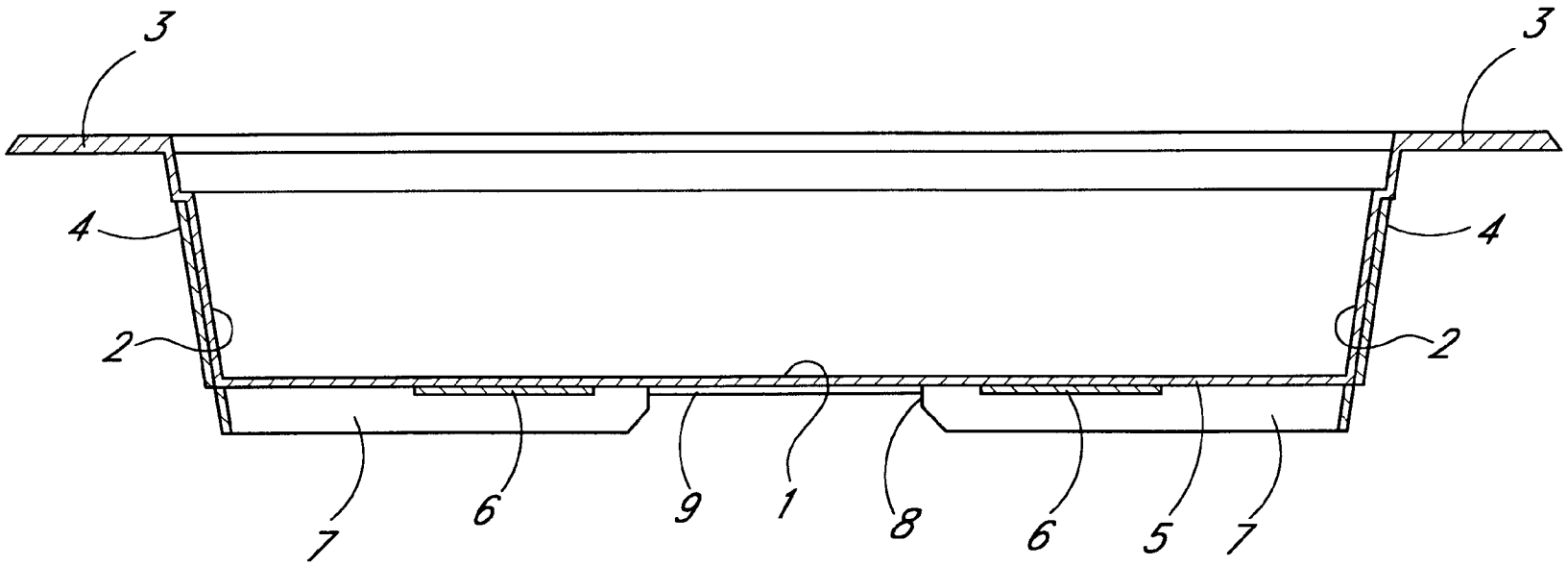
FIG. 3 is a schematic cross sectional view of the container A cross-sectioned at a line 3—3 illustrated in FIG. 2.

FIG. 1 is a schematic front view showing a food container A for microwave heating or cooking. FIG. 2 is a schematic plane view of the container A illustrated in FIG. 1. FIG. 3 is a schematic cross sectional view of the container A cross-sectioned at a line 3—3 illustrated in FIG. 2. The container is comprised of a bottom plate 1 having an oval shape and a side wall 2 extending upward from the circumference of the bottom plate (a height of the inner surface of the side wall is 20 mm), as well as a rim extending outwardly and horizontally provided on the upper edge of the side wall 2. A leg structure 7 having a height of 5 mm is provided on the back of the bottom plate 1. The leg structure 7 can be formed along the circumference of the bottom plate 1, or can be formed smaller than the bottom plate 1, or further can be formed discontinuously. In FIG. 1, the leg structure 7 has a cut-out portion 8, i.e., is discontinuous.

This container has the following dimensions: the internal longer diameter of the upper portion is 135 mm, the internal shorter diameter of the upper portion is 115 mm, the height is 20 mm, and the storage capacity is 220 ml.

Attaching Microwave Non-transmittable Material

The entire surface of the side wall 2 of the container A is covered with a two-layer laminated film 4 which is a laminated film of an aluminum foil and a synthetic resin film.

FIG. 4 is a schematic bottom view showing the outer surface 5 of the container A, wherein two circular pieces of aluminum foil 6 (diameter: 20 mm) are attached onto the oval bottom plate 1 (longer diameter: 125 mm, shorter diameter: 105 mm). The two circular pieces of aluminum foil 6 are lined up in the longer diameter direction, each located between the center and the edge.

The aluminum foil 4 attached to the side wall 2 extends to the bottom plate 1 via the cut-out portion 8 of the leg structure 7. FIG. 4 shows the extending portion 9 on the outer surface 5 of the bottom plate 1.

Example 2

In Example 2, the same container as in Example 1 is used, except that two additional circular pieces of aluminum foil (diameter: 20 mm) are attached to the bottom plate 1 in the shorter diameter direction, each located between the center and the edge. Thus, four circular pieces of aluminum foil are used in total.

Experiments

In order to confirm the effects of the container for microwave heating or cooking obtained in Examples 1 and 2, heating tests using a frozen gratin were conducted.

In the experiments, containers used as comparative examples were as described below. In the comparative examples, the manner of attaching aluminum foil to the side wall 2 was the same as in Example 1. All pieces of aluminum foil attached to the bottom plate 1 were circular and had a diameter of 20 mm.

Comparative Example 1

A container had the same shape as in Example 1 except that the container had no leg structure. Neither the side wall 2 nor the bottom plate 1 was covered with aluminum foil.

Comparative Example 2

A container had the same shape as in Example 1 except that the container had no leg structure. The side wall 2 was covered with aluminum foil, but the bottom plate 1 was not covered.

Comparative Example 3

A container had the same shape as in Example 1 including the leg structure 7. Neither the side wall 2 nor the bottom plate 1 was covered with aluminum foil.

Comparative Example 4

A container had the same shape as in Example 1 except that the container had no leg structure. The side wall 2 was covered with aluminum foil, and the bottom plate 1 was covered with two pieces of aluminum foil.

Each of the containers of Examples 1 and 2, and Comparative Examples 1–4 was packed with 220 g of a gratin in a conventional way, and frozen at −18° C. Each container packed with the frozen gratin was heated with a microwave oven (Sanyo Denki, Oven Range EMO-VA4(HD)) for five minutes, and then the inside temperatures were measured at the locations indicated in FIG. 6. The results are shown in Table 1.

TABLE 1

| | Temperature (° C.) | | | |
|---|---|---|---|---|
| | T1 | T2 | T3 | T4 |
| Ex. 1 | 64.5 | 69.0 | 68.0 | 76.7 |
| Ex. 2 | 65.1 | 85.6 | 85.2 | 67.1 |
| Comp. Ex. 1 | 28.5 | 87.2 | 88.4 | 58.7 |
| Comp. Ex. 2 | 42.4 | 86.6 | 89.9 | 57.3 |
| Comp. Ex. 3 | 27.4 | 87.4 | 89.1 | 85.2 |
| Comp. Ex. 4 | 57.8 | 81.1 | 68.6 | 76.8 |

As indicated in Table 1, according to the containers in Examples 1 and 2, the temperature in the center (T1) was high and further, the temperature differences depending on the location were low. In contrast, according to the containers in Comparative Examples 1–4, the temperature in the center was generally low, and the temperature differences between the center and the side were high, i.e., uneven heating occurred and the containers were found unsuitable for microwave heating.

Further, the four pieces of aluminum foil were changed to be located on the outer surface 5 of the bottom plate 1 as shown in FIG. 5. The same results as above were obtained.

In the above, even when an aluminum deposition film was used instead of aluminum foil, and even when an aluminum foil used on the side wall had a height of 10 mm, the same results as above were obtained.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A food container for microwave heating or cooking, comprising:

a bottom portion made of a microwave transmittable material and having a center and a periphery, said bottom portion being adapted to contact food to be heated or cooked with microwaves and having an area covered with a microwave reflective material or a microwave non-transmittable material, said covered area being composed of plural individual insular areas located between the center and the periphery and occupying 5% to 20% of the entire area of the bottom portion;

a side wall made of a microwave transmittable material and having an area extending around the side wall, said area covered with a microwave reflective material or a microwave non-transmittable material; and a leg structure provided under the bottom portion, said leg structure having a height of 3–10 mm.

2. The food container according to claim 1, wherein the leg structure is formed continuously or discontinuously under the bottom portion.

3. The food container according to claim 1, wherein the leg structure is formed discontinuously and has a cut-out portion under the bottom portion, and the covering on the side wall using the microwave reflective material or the microwave non-transmittable material extends to the bottom portion via the cut-out portion.

4. The food container according to claim 1, wherein the covering on the side wall using the microwave reflective material or the microwave non-transmittable material is an aluminum foil laminated film or an aluminum vapor-deposition film adhered to the side wall or an aluminum vapor-deposition layer directly formed on the side wall.

5. The food container according to claim 1, wherein the covering on the side wall has at least a height corresponding to the height of a food when stored therein.

6. The food container according to claim 1, wherein the covering on the bottom portion using the microwave reflective material or the microwave non-transmittable material is circular, oval, four-sided, star-shaped, triangular, or horseshoe-shaped.

* * * * *